US005475988A

United States Patent [19]

McGovern

[11] Patent Number: 5,475,988

[45] Date of Patent: Dec. 19, 1995

[54] REFRIGERATED DISPLAY CASE WITH AN IMPROVED AIR FLOW CONTROL AND A CONTAMINANT CONTROL APPARATUS

[75] Inventor: Christopher McGovern, Allentown, N.J.

[73] Assignee: Delaware Capital Formation Inc., Wilmington, Del.

[21] Appl. No.: 341,722

[22] Filed: Nov. 17, 1994

[51] Int. Cl.[6] ..... A47F 3/04

[52] U.S. Cl. ..... 62/256

[58] Field of Search ..... 62/255, 256

[56] References Cited

U.S. PATENT DOCUMENTS

| | | |
|---|---|---|
| D. 180,072 | 4/1957 | Dickson et al. . |
| D. 231,819 | 6/1974 | Perez et al. . |
| D. 302,910 | 8/1989 | Cocagne . |
| D. 334,495 | 4/1993 | Bustos . |
| 1,614,319 | 1/1927 | Schmidt . |
| 1,948,312 | 2/1934 | Phillips . |
| 2,223,761 | 12/1940 | Hall et al. . |
| 2,476,491 | 7/1949 | Henderson . |
| 2,490,413 | 12/1949 | Burtis . |
| 2,528,916 | 11/1950 | Shreve . |
| 2,529,384 | 11/1950 | Greiling . |
| 2,794,325 | 6/1957 | Shearer . |
| 2,822,672 | 2/1958 | Dickson et al. . |
| 2,836,039 | 5/1958 | Weber . |
| 2,952,992 | 9/1960 | Voorhies . |
| 3,006,707 | 10/1961 | Rossi . |
| 3,063,252 | 11/1962 | Lamb . |
| 3,063,255 | 11/1962 | Fanick, Jr. et al. . |
| 3,218,822 | 11/1965 | Bently et al. . |
| 3,304,740 | 2/1967 | Dickson et al. . |
| 3,347,145 | 10/1967 | Steelman . |
| 3,392,543 | 7/1968 | Miller . |
| 4,265,090 | 5/1981 | Abraham . |
| 4,288,992 | 9/1981 | Eliason . |
| 4,338,792 | 7/1982 | Ibrahim . |
| 4,347,710 | 9/1982 | Ibrahim . |
| 4,389,852 | 6/1983 | Abraham . |
| 4,404,816 | 9/1983 | Ibrahim et al. . |
| 4,414,822 | 11/1983 | Ibrahim . |
| 4,439,992 | 4/1984 | Ibrahim . |
| 4,449,374 | 5/1984 | Ibrahim . |
| 4,457,139 | 7/1984 | Ibrahim . |
| 4,489,995 | 12/1984 | Barr . |
| 4,577,467 | 3/1986 | Ibrahim et al. . |
| 4,691,527 | 9/1987 | Ikeda . |
| 4,741,172 | 5/1988 | Aoki . |
| 4,831,780 | 5/1989 | Bockwinkel . |
| 4,870,735 | 10/1989 | Jahr, Jr. et al. . |
| 4,882,910 | 11/1989 | Meehan et al. . |
| 4,945,732 | 8/1990 | Haruyama et al. . |
| 5,009,080 | 4/1991 | Naganuma et al. . |
| 5,031,413 | 7/1991 | Isuihiji et al. . |
| 5,138,843 | 8/1992 | Tamayama et al. . |
| 5,201,191 | 4/1993 | Bustos . |
| 5,261,253 | 11/1993 | Spenard . |

FOREIGN PATENT DOCUMENTS

| | | |
|---|---|---|
| 5177479 | 10/1979 | Australia . |
| 780620 | 3/1968 | Canada . |

*Primary Examiner*—William E. Tapolcai
*Attorney, Agent, or Firm*—Sperry, Zoda & Kane

[57] ABSTRACT

A refrigerated display case with an improved air flow control system located in the lower portion thereof along with an improved means for controlling spillages and other contaminants which commonly fall downwardly into the tank or lower area thereof. The spillage controls including a waste control outlet along with an inclined coil cover and fan housing as well as a deck plate extending thereover. The deck plate also defining the plenum chamber within which the inclined fan housing and inclined coil and coil cover are located. A front bracket is included which allows attachment of a return grill thereto along with a support shelf for holding the refrigeration line means away from the waste receiving outlet.

21 Claims, 5 Drawing Sheets

REFRIGERATED DISPLAY CASE WITH AN IMPROVED AIR FLOW CONTROL AND A CONTAMINANT CONTROL APPARATUS

BACKGROUND OF THE INVENTION

1. Field of the Invention

The present invention deals with the field of devices for maintaining product refrigerated within a display case and readily available to customers, Such display cases preferably include an open frontal area to facilitate access by supermarket customers to product displayed therein, Such displayed product while maintained on display commonly generate spillages and other contaminants which fall downwardly within the case to the area therebelow, The lower area or tank area of such a displayed case can experience significant accumulations of contaminants or spillages including standing liquid spillages which cause problems in maintaining the required sanitary conditions therein, The present invention provides a novel multi-layered overlapping construction for controlling such contaminants and urging movement thereof to a waste control area while at the same time minimizing contact of such contaminations with respect to the refrigeration coil or plenum or other important refrigeration system parts which may be located in the lower or tank area of the refrigerated display case.

2. Description of the Prior Art

Numerous prior arts designs for refrigerated display cases including air flow controls and contaminant removal systems have been patented such as shown in U.S. Pat. No. 1,614,319 issued Jan. 11, 1927 to G. Schmidt and assigned to The Cincinnati Butchers' Supply Company on a "Refrigerator Show Case"; and U.S. Pat. No. 1,948,312 issued Feb. 20, 1934 to A. V. Phillips and assigned to Kelvinator Corporation on a "Refrigerated Display Case"; and U.S. Pat. No. 2,223,761 issued Dec. 3, 1940 to K. W. Hall et al and assigned to Tolco, Inc. on an "Air Conditioned Display Counter"; and U.S. Pat. No. 2,476,491 issued Jul. 19, 1949 to E. O. Henderson and assigned to Alma Serena Henderson on a "Refrigerating Apparatus"; and U.S. Pat. No. 2,490,413 issued Dec. 6, 1949 to W. R. Burtis and assigned C. V. Hill & Company, Inc. on a "Self-Service Refrigerated Display Case"; and U.S. Pat. No. 2,528,916 issued Nov. 7, 1950 to C. B. Shreve and assigned to Tyler Fixture Corporation on "Refrigerated Shelving"; and U.S. Pat. No. 2,529,384 issued Nov. 7, 1950 to D. J. Greiling and assigned to McCray Refrigerator Company on a "Refrigerated Self-Service Display Case"; and U.S. Pat. No. 2,794,325 issued Jun. 4, 1957 to W. B. Shearer and assigned to General Motors Corporation on a "Refrigerated Display Case"; and U.S. Pat. No. 2,822,672 issued Feb. 11, 1958 to E. V. Dickson et al and assigned to Hussmann Refrigerator Co. on a "Display Case With Adjustable Refrigerated Shelves"; and U.S. Pat. No. 2,836,039 issued May 27, 1958 to K. A. Weber and assigned to Weber Showcase & Fixture Co., Inc. on a "Refrigerated Self-Service Showcase"; and U.S. Pat. No. 2,952,992 issued Sep. 20, 1960 to D. A. Voorhies and assigned to C. V. Hill & Company, Inc. on a "Refrigerated Shelf"; and U.S. Pat. No. 3,063,252 issued Nov. 13, 1962 to F. G. Lamb on an "Upright Refrigerator Showcase"; and U.S. Pat. No. 3,063,255 issued Nov. 13, 1962 to E. A. Fanick, Jr. et al and assigned to Ed Friedrich, Incorporated on "Refrigerated Display Cabinets"; and U.S. Pat. No. 3,218,822 issued Nov. 23, 1965 to G. K. Bently et al and assigned to McCray Refrigerator Company, Inc. on a "Frozen Food Display Case"; and U.S. Pat. No. 3,304,740 issued Feb. 21, 1967 to E. V. Dickson et al and assigned to Pet Incorporated on an "Open Front Display Case"; and U.S. Pat. No. 3,347,145 issued Oct. 17, 1967 to M. W. Steelman and assigned to Clark Equipment Company on an "Air Distribution Structure For Refrigerated Case"; and U.S. Pat. No. 3,392,543 issued Jul. 16, 1968 to G. A. Miller and assigned to Clark Equipment Company on a "Separable-Section Refrigerated Case"; and U.S. Pat. Des. No. 231,819 issued Jun. 18, 1974 to A. Perez et al and assigned to Clark Equipment Company on a "Refrigerated Food Display Case"; and U.S. Pat. No. 4,265,090 issued May 5, 1981 to F. Ibrahim and assigned to Tyler Refrigeration Corporation on a "Glass Door Merchandiser With Ambient Air Defrost"; and U.S. Pat. No. 4,288,992 issued Sep. 15, 1981 to C. Eliason and assigned to Eliason Corporation on a "Curtain For Open Front Freezer Or Refrigerator"; and U.S. Pat. No. 4,338,792 issued Jul. 13, 1982 to F. Ibrahim and assigned to Tyler Refrigeration Corporation on a "Refrigerated Merchandiser Display Case With Defrost Device"; and U.S. Pat. No. 4,347,710 issued Sep. 7, 1982 to F. Ibrahim and assigned to Tyler Refrigeration Corporation on a "Glass Door Merchandizer With Tertiary Air Band"; and U.S. Pat. No. 4,389,852 issued Jun. 28, 1983 to F. Abraham and assigned to Tyler Refrigeration Corporation on a "One And A Half Band Refrigerated Display Case"; and U.S. Pat. No. 4,404,816 issued Sep. 20, 1983 to F. Ibrahim et al and assigned to Tyler Refrigeration Corporation on a "Modular Refrigeration Assembly Having Air Defrost System"; and U.S. Pat. No. 4,414,822 issued Nov. 15, 1983 to F. Ibrahim and assigned to Tyler Refrigeration Corporation on a "Refrigerated Display Case With Colliding Band Air Defrost"; and U.S. Pat. No. 4,439,992 issued Apr. 3, 1984 to F. Ibrahim and assigned to Tyler Refrigeration Corporation on an "Open Top Refrigerated Case With Defrost Air Intake And Colliding Band Air Defrost"; and U.S. Pat. No. 4,449,374 issued May 22, 1984 to F. Ibrahim and assigned to Tyler Refrigeration Corporation on a "Combination Hot Gas And Air Defrost Refrigerated Display Case"; and U.S. Pat. No. 4,457,139 issued Jul. 3, 1984 to F. Ibrahim and assigned to Tyler Refrigeration Corporation on a "Refrigerated Display Case Having Ambient Air Defrost"; and U.S. Pat. No. 4,489,995 issued Dec. 25, 1984 to R. Barr and assigned to Tyler Refrigeration Corporation on an "Adjustable Electrical Outlet Assembly"; and U.S. Pat. No. 4,577,467 issued Mar. 25, 1986 to F. Ibrahim et al and assigned to Tyler Refrigeration Corporation on a "Frost Diffusion System For Refrigeration Apparatus"; and U.S. Pat. No. 4,691,527 issued Sep. 8, 1987 to H. Ikeda and assigned to Sanden Corporation on a "Control Device For Refrigerated Display Case"; and U.S. Pat. No. 4,741,172 issued May 3, 1988 to S. Aoki and assigned to Sanden Corporation on a "Refrigerated Display Cabinet"; and U.S. Pat. No. 4,831,780 issued May 23, 1989 to G. Bockwinkel and assigned to Ardco Inc. on a "Refrigerator Door Assembly With Thermal Break Frame"; and U.S. Pat. Des. No. 302,910 issued Aug. 22, 1989 To P. Cocagne on a "Refrigerated Display Case"; and U.S. Pat. No. 4,870,735 issued Oct. 3, 1989 to R. Jahr, Jr. et al and assigned to White Consolidated Industries, Inc. on a "Refrigeration Cabinet Construction"; and U.S. Pat. No. 4,882,910 issued Nov. 28, 1989 to K. Meehan et al on a "Refrigeration System For Product Display Enclosures"; and U.S. Pat. No. 4,945,732 issued Aug. 7, 1990 to Y. Haruyama et al and assigned to Sanden Corporation on a "Refrigerated Display Case With A Damper Controlled Defrosting Mechanism"; and U.S. Pat. No. 5,009,080 issued Apr. 23, 1991 to H. Naganuma et al and assigned to Sanyo Electric Co., Ltd. on a "Low-Temperature Show Case"; and U.S. Pat. No. 5,031,413 issued Jul. 16, 1991 to S. Tsuihiji et al and assigned to Sanyo Electric Co., Ltd. on a "Low-Temperature Foods Preserving Case And Its Temperature Control Method"; and U.S. Pat. No. 5,138,843 issued Aug. 18, 1992 to H. Tamayama et al and assigned to Sanyo Electric Co., Ltd. on a "Method For Operating An Open Show-Case"; and U.S. Pat. Des. No. 334,495 issued Apr. 6, 1993 to R. Bustos and assigned to Leggett & Platt, Incorporated on a "Refrigerated Display Case"; and U.S. Pat. No. 5,201,191 issued Apr. 13, 1993 to R. Bustos and assigned to Leggett & Platt, Inc. on a "Refrigerated Merchandiser"; and U.S. Pat. No. 5,261,253 issued Nov. 16, 1993 to Jean-Clause Spenard on a "Refrigerated Display Cabinet"; and Australian Pat. No. 51,774/79 on a "Refrigerated Display Unit"; and Canadian Pat. No. 780,620 issued Mar. 19, 1968 to M. Steelman and assigned to Clark Equipment Company on an "Air Distribution Structure".

SUMMARY OF THE INVENTION

The present invention provides a refrigerated display case apparatus which has an improved air flow control extending throughout the case and an improved contaminant containment and flow control located primarily in the lower or tank portion thereof. The air flow control means includes a novel plenum configuration with multiple layers to form a plenum contaminant control construction for minimizing contamination of the working parts within the lower portion of the refrigerated display case by minimizing contamination of such parts as the refrigeration coil from spillages or other contaminants while also providing easy access to parts located within the tank plenum for servicing. Also full access to the refrigeration coil can be provided without requiring the removal of any clips or fasteners of any kind. This design is particularly usable with a refrigerated display case having a frontal opening which is designed to have a refrigerated air curtain extending thereover.

In the preferred configuration of the present invention an upper air conduit extends generally upwardly along the refrigerated display case in the rear portion thereof and outwardly along the upper or canopy section to define an upper flow path therein for conveying refrigerated air. This upper air conduit includes an air outlet preferably located immediately above the frontal opening of the refrigerated display case in such a manner as to release refrigerated air therefrom and form a refrigerated air curtain extending downwardly therefrom. In order to achieve this desired effect the air outlet should be in fluid flow communication with respect to the upper air conduit.

In a similar manner a lower air conduit is preferably defined in the front lower portion of the refrigerated display case, often referred to as the front sill, which is relatively short but extends upwardly within the refrigerated display case from the lower or tank area in order to define the lower air flow path which extends upwardly from the plenum. This lower air flow path will include an air inlet preferably in the upper area thereof which is positioned preferably immediately below the frontal opening to receive air from the refrigerated air curtain extending downwardly thereover. This air inlet should be in fluid flow communication with respect to the lower air flow path to implement the front air curtain configuration. The entire air flow path will extend from the air inlet to the air outlet and will further include the air curtain extending over the frontal air access opening.

The plenum housing of the present invention is located preferably in the lower or tank area of the refrigerated display case and is in communication with respect to the bottom portion of the upper air conduit and the bottom portion of the lower air conduit. This plenum housing preferably also defines a plenum chamber therein in fluid flow communication with respect to the lower air flow path of the lower air conduit to receive air therefrom returning from the air inlet from the refrigerated air curtain while at the same time being in fluid flow communication with respect to the upper air flow path of the upper air conduit to supply refrigerated air thereto for exit through the air outlet at the upper portion of the frontal opening. In this manner the plenum chamber along with the lower air conduit and the upper air conduit provides a complete air flow circuit for providing air at the air outlet and receiving air from the air inlet thereby forming the refrigerated air curtain extending thereover.

The plenum housing preferably includes a plenum outer liner extending from the lower air conduit to the upper air conduit to thereby define the outer wall or outer limit of the plenum chamber. This plenum outer liner will also include a waste receiving device such as a waste outlet therein which is adapted to facilitate the gathering of contaminants from within the refrigerated display case. The inner boundary of the plenum chamber is defined by a deck plate which is preferably positioned in abutment with respect to the lower air conduit as well as with respect to the upper air conduit in such a manner as to extend over the plenum chamber therebetween and define an inner wall for the plenum chamber. The inner wall and the outer wall thereby cooperate to define the plenum chamber therebetween. The deck plate preferably is rested in abutment with the refrigerated display case to define this inner boundary while being easily removable to access the system parts located therebelow. The deck plate can be configured formed in a plurality of sections positioned adjacent to one another and preferably mutually interlocking to further impede the flow of contaminants downwardly thereby. This deck plate is preferably configured inclined downwardly toward the waste receiving outlet to facilitate movement of contaminants therein and to keep contaminants away from the refrigeration coil and the fans and other parts associated therewith. The deck plate members can be oriented horizontally such as for use in a refrigerated display case used for display of dairy products therein.

The apparatus of the present invention further includes an air flow control apparatus positioned within the plenum chamber which includes a coil housing having a refrigeration coil mounted therein. This coil housing is preferably positioned within the plenum chamber for cooling of air therein. A coil cover may be included positionable extending outwardly over the refrigeration coil means for protection thereof and to inhibit movement of contaminants or spillages therein. The coil cover also facilitates air flow through the refrigeration coil for cooling thereof. This coil cover is preferably inclined downwardly toward the waste receiving outlet to facilitate movement of any contaminants thereto. The coil cover is preferably pivotally attached with respect to the coil housing means to facilitate selective access to the refrigeration coil for maintenance such as cleaning or defrosting and facilitates air flow through the coil for cooling thereof. It should be appreciated that no fasteners are required to mount the coil cover in place despite it being pivotally movable with respect to the coil housing. The capacity for pivotal movement can be achieved by metal tabs extending into slots defined in the coil housing to thereby provide this pivotally moveable attachment therebetween. As such this construction will maximize sanitary considerations by eliminating screw heads, nuts, threads or other similar small areas where contaminants tend to collect.

A fan panel may be included positioned within the plenum chamber pivotally mounted adjacent the coil housing for moving air therethrough for refrigeration. This fan panel may preferably include from one to four or, preferably, three fan openings therein, each of which is adapted to receive a fan positioned removably therein. The fan panel means is pivotally mounted with respect to the coil housing means to facilitate further access to. The fan panel preferably is inclined downwardly toward the waste receiving outlet to urge movement of contaminants therein. A fan is designed to be positioned within a fan basket housing with the combined fan and basket assembly designed to be positioned within each of the fan openings defined in the fan panel. The fan housing provides protection for the fan and protection for the operator when working around the fan panel by preventing damage from the rotating blades or damage to the fan during maintenance operations performed in the tank area. The fan basket housing can also include a flange extending therearound to provide a means for inhibiting the movement of contaminants through the fan opening. Each fan and associated motor is separately removal from the fan panel for replacement or servicing as desired.

The design of the present invention may also include a front bracket fixedly secured to the lower air conduit. A return grill may be securable with respect to the front bracket such as to extend over the lower air inlet for protection thereof and to improve the aesthetic appearance thereof. The return grill can also include a deck lip extending outwardly therefrom adapted to receive the deck plate positioned thereon to facilitate positioning of the deck plate with respect to the lower air conduit. The deck plate can also be positioned in abutment with respect to a rear panel secured to the upper air conduit and extending horizontally outwardly therefrom. In this manner the deck plate can be positionable in selective abutment with respect to the rear panel as well as the return grill to provide ease of positioning and replacement, removal or maintenance of the deck panel and the areas immediately therebelow.

The bracket can also include a support shelf for holding of refrigeration lines such as the liquid return line or other lines which are normally located in the lower portion of a refrigerated display case at an elevated position with respect to the waste accumulation outlet and surrounding areas to thereby facilitate cleaning. Also a recessed waste gathering area can be included surrounding the waste receiving outlet which is slightly lower than the surrounding portion of the outer wall to facilitate the accumulation of contaminants and movement thereof into the waste outlet.

The coil cover which is inclined downwardly toward the fan panel which is, in turn, inclined further downwardly toward the waste outlet will also preferably include a coil cover gasket to further control contamination of the refrigeration coil located therebelow.

It is an object of the present invention to provide a refrigerated display case with an improved air flow control means and enhanced plenum contaminant control means wherein serviceability is significantly enhanced.

It is an object of the present invention to provide a refrigerated display case with an improved air flow control means and enhanced plenum contaminant control means wherein down-time is minimized.

It is an object of the present invention to provide a refrigerated display case with an improved air flow control means and enhanced plenum contaminant control means wherein initial additional capital cost requirements are minimized.

It is an object of the present invention to provide a refrigerated display case with an improved air flow control means and enhanced plenum contaminant control means wherein multiple layers of contaminant and spillage control are provided to enhance case sanitation.

It is an object of the present invention to provide a refrigerated display case with an improved air flow control means and enhanced plenum contaminant control means wherein a control of contaminants especially spillages is achieved to minimize possible soiling or damaging of the refrigeration coil.

It is an object of the present invention to provide a refrigerated display case with an improved air flow control means and enhanced plenum contaminant control means wherein a deck plate is included as an initial layer of spillage or contamination control designed to urge movement of contaminations away from the refrigeration coil and toward the waste control outlet.

It is an object of the present invention to provide a refrigerated display case with an improved air flow control means and enhanced plenum contaminant control means wherein a coil cover is included inclined toward the waste control outlet and extending over the refrigeration coil which includes a gasket means therein for minimizing contamination of the refrigeration coil.

It is an object of the present invention to provide a refrigerated display case with an improved air flow control means and enhanced plenum contaminant control means wherein a fan housing is included inclined downwardly from the coil cover toward the waste control outlet to facilitate movement of contaminants and spillages therein.

It is an object of the present invention to provide a refrigerated display case with an improved air flow control means and enhanced plenum contaminant control means wherein access is provided to the waste outlet without requiring removal or, in fact, any movement of the fan panel or housing.

It is an object of the present invention to provide a refrigerated display case with an improved air flow control means and enhanced plenum contaminant control means wherein refrigerated air control is more accurately maintained thereby increasing freshness of the displayed product.

It is an object of the present invention to provide a refrigerated display case with an improved air flow control means and enhanced plenum contaminant control means wherein sanitary lower tank conditions are greatly facilitated by easily removable panels for maintenance.

It is an object of the present invention to provide a refrigerated display case with an improved air flow control means and enhanced plenum contaminant control means wherein positioning of the waste outlet within a downwardly recessed drain area enhances collection of contaminants therein.

It is an object of the present invention to provide a refrigerated display case with an improved air flow control means and enhanced plenum contaminant control means wherein the corners have gradual radiuses to enhance contaminant collection and prevent accumulation of contaminants therein.

It is an object of the present invention to provide a refrigerated display case with an improved air flow control means and enhanced plenum contaminant control means wherein individual fans and associated motors are easily removable for replacement and/or servicing thereof.

It is an object of the present invention to provide a refrigerated display case with an improved air flow control means and enhanced plenum contaminant control means wherein lower deck lids can easily be removed to facilitate access to a recessed waste control area surrounding a waste outlet.

It is an object of the present invention to provide a refrigerated display case with an improved air flow control means and enhanced plenum contaminant control means wherein a cover is provided on the refrigeration coil which can be lifted to facilitate access to the coil for cleaning or fast defrosting thereof.

It is an object of the present invention to provide a refrigerated display case with an improved air flow control means and enhanced plenum contaminant control means wherein a fan panel for housing of the fan apparatus is included which is pivotally movable with respect to the refrigeration coil housing to facilitate further access thereto to enhance cleaning or defrosting thereof.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
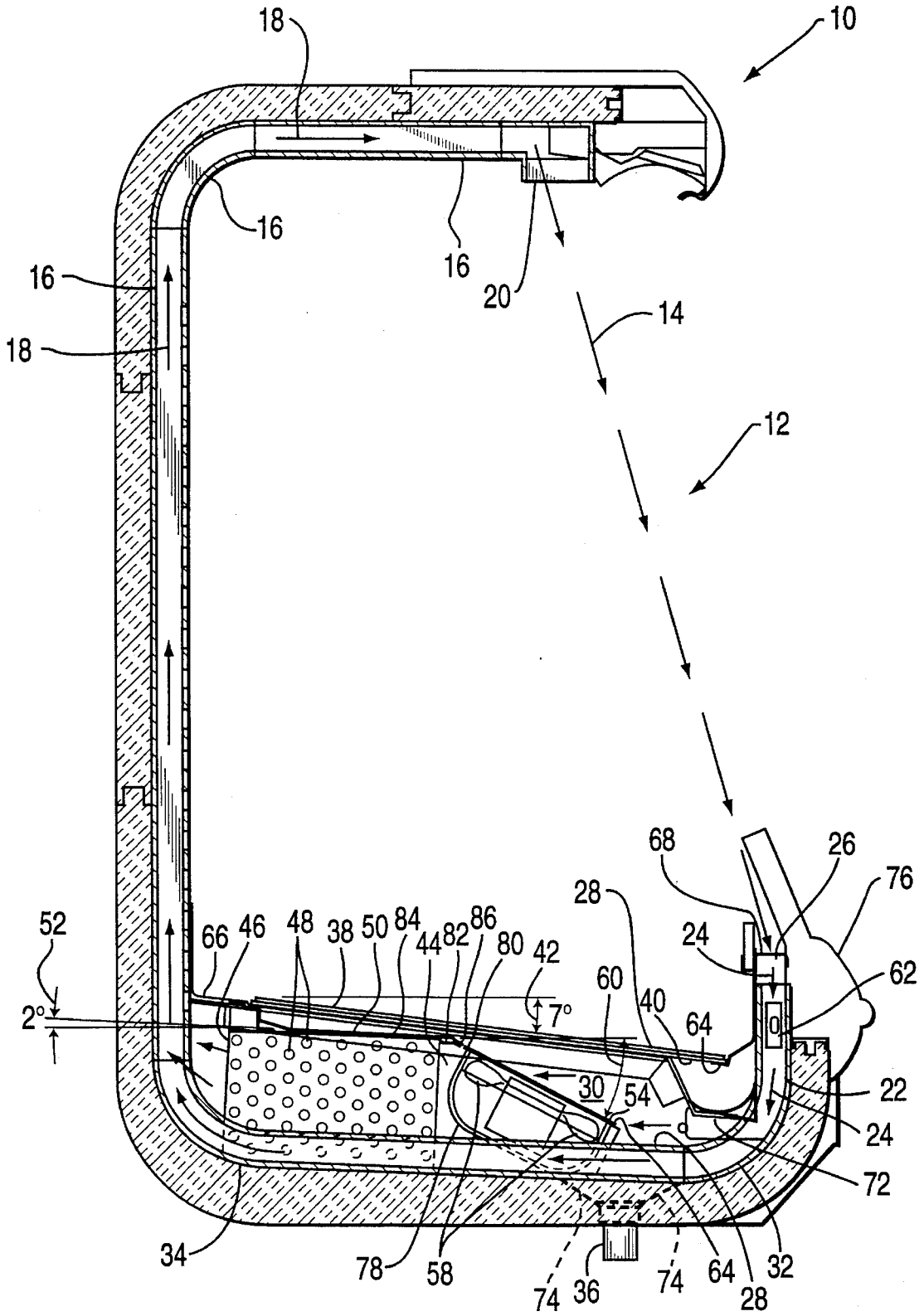
FIG. 1 is a side cross-sectional view of an embodiment of the refrigerated display case of the present invention.
Figure 2:
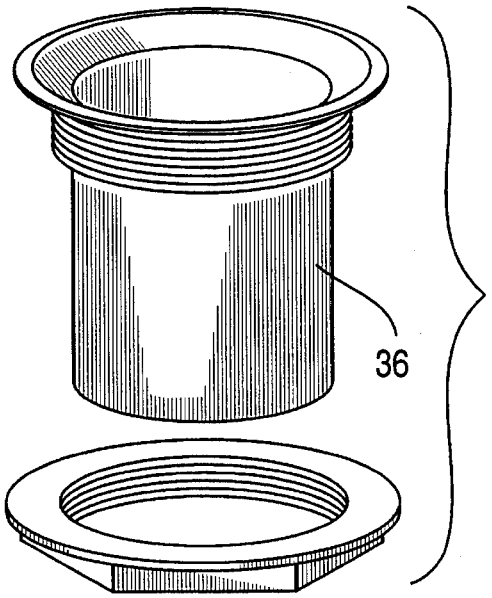
FIG. 2 is a perspective illustration of an embodiment of a waste outlet apparatus as used with the present invention.
Figure 4:
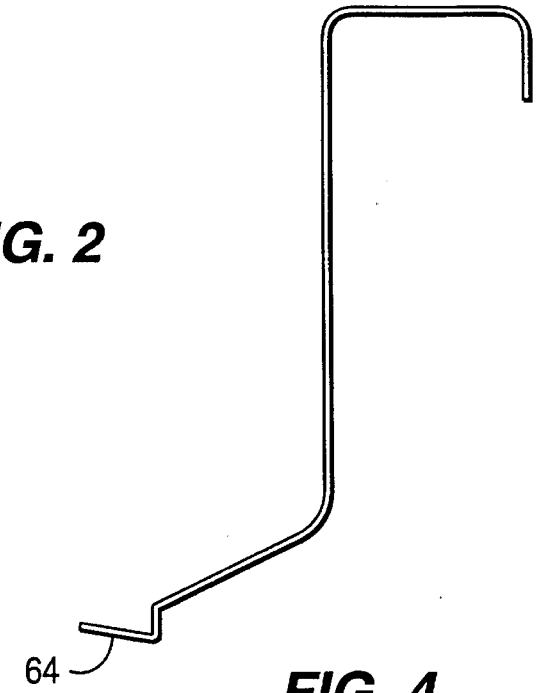
FIG. 4 is a side cross-sectional view of an embodiment of the device shown in FIG. 3.
Figure 3:
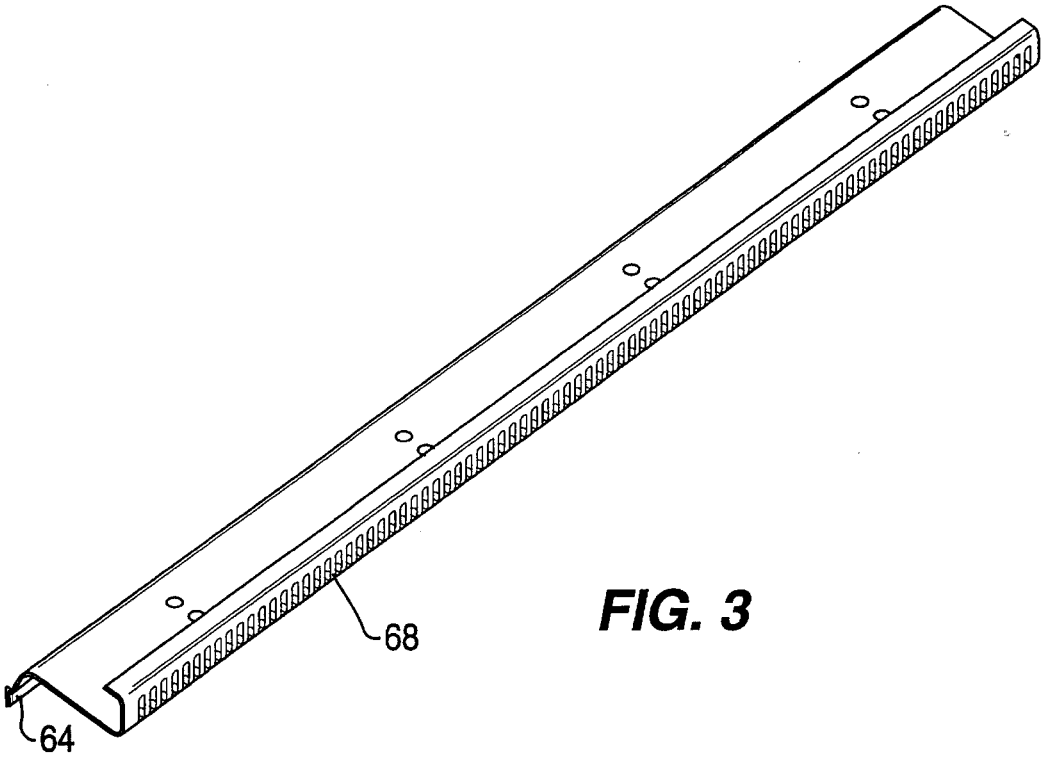
FIG. 3 is a perspective illustration of an embodiment of the return grill of the present invention.
Figure 5:
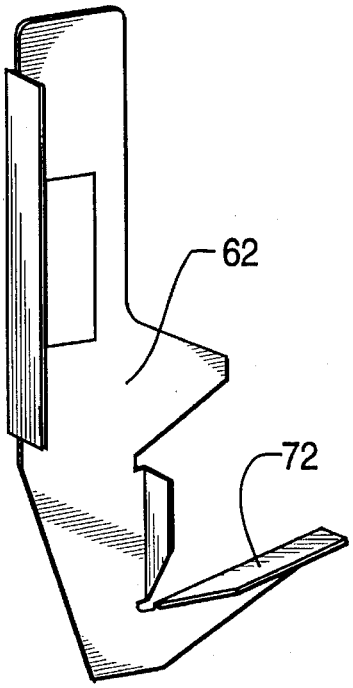
FIG. 5 is a perspective illustration of a front bracket member of the present invention.
Figure 11:
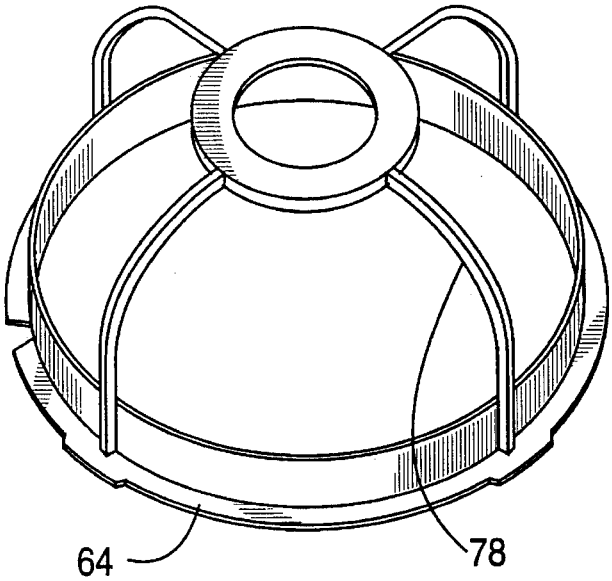
FIG. 11 is a perspective illustration of an embodiment of the fan basket housing of the present invention.

The present invention provides a refrigerated display case 10 which includes a frontal opening 12 therein to facilitate access to the interior of the display case by a supermarket or other customer. To control the refrigeration of items positioned within the display case 10, a refrigerated air curtain 14 is preferably positioned to extend over the frontal opening 12 to retain the refrigerated air therein and to minimize the loss of cooling therethrough.

This refrigerated air curtain is created by air exiting through an air outlet 20 at the upper portion of the frontal opening 12. The refrigerated air curtain extends downwardly therefrom into the air inlet 26 located below the frontal opening 12. A complete air flow path or circuit extends from the air inlet 26 through the refrigerated display case to the air outlet 20. This air circuit is achieved first by a lower air conduit 22 which defines a lower air flow path 24 therein extending from the air inlet 26 to the plenum housing 28. Plenum housing 28 defines a plenum chamber 30 therein which is in fluid flow communication with respect to the lower air flow path 24. Within the plenum housing 28 the air is preferably cooled and urged to move through the air flow circuit defined within the refrigerated display case 10 by a fan means.

Plenum chamber 30 is also in fluid flow communication with respect to an upper air flow path 18 which extends from the plenum chamber 30 upward through the upper air conduit 16 within which the upper air flow path 18 is defined to the air outlet 20 in the canopy portion of the refrigerated display case 10.

Thus, as can be seen best in FIG. 1, the lower air flow path 24 extends from the air inlet 26 to the plenum chamber 30 and the upper air flow path 18 extends from the plenum chamber 30 to the air outlet 20. Thus, the entire air flow circuit is complete between the air inlet and the air outlet. The external portion of the air flow circuit then extends from the air outlet 20 to the air inlet 26 with the air curtain 14 extending over the frontal opening 12.

Control of air moving through the circuit is achieved by the inclusion of fans and the positioning of the refrigeration coil 48 within the plenum housing 28. Control of air movement is achieved by a plenum outer liner 32 extending in a general U-shape throughout the lower portion of the refrigerated display case 10. This plenum outer liner 32 provides the outer wall or outer boundary 34 of the air flow path within the plenum housing 28. In other words the outer wall 34 defines the outermost boundary of plenum chamber 30. In a similar manner a deck plate 38 extends between the upper air conduit 16 and the lower air conduit 22 in such a manner as to define the inner wall 40 which comprises the innermost boundary of the plenum chamber 30 and, as such, the innermost boundary of the air flow path therethrough within plenum chamber 30.

This deck plate 38 will preferably extend in a slightly downward inclination preferably of approximately seven degrees, or in some alternate configurations at approximately one degree, such that any spillages or other contaminants moving downwardly in the refrigerated display case 10 which contact the deck plate 38 will be urged to move toward the right as shown in FIG. 1 toward a waste receiving means 36 defined in the plenum outer liner 32 therebelow. However, it has been found that in refrigerated display cases used for holding dairy products that the deck plate means 38 can be oriented extending generally horizontally in certain applications.

The waste receiving means 36 will preferably include a waste outlet means which is designed to remove contaminants such as spillages and the like from the refrigerated display case 10 downwardly for gathering and disposal thereof. To enhance movement of contaminants and other spillages to the waste outlet means 36, a recessed waste gathering area 74 can be included defined in the area of the outer wall 34 immediately surrounding the waste outlet means 36. In this manner movement of contaminants to the waste outlet means 36 is significantly enhanced. The recessed waste gathering area 74 will preferably comprise a slight depression in the surrounding area of the outer wall 34 as shown best in profile in FIG. 1.

The present invention further includes an air flow control apparatus 44 which includes a coil housing 46 adapted for retaining a refrigeration coil means 48 therein. A fan panel 54 is positioned preferably adjacent to the refrigeration coil 48 to facilitate air flow therethrough. Fan panel 54 preferably defines one or more fan openings 56 therein. Each fan opening is defined to receive a fan means 58 positioned therein. The fans are designed to force air through the refrigeration coil 48 for cooling thereof and to achieve circulation and movement of air through the air flow circuit of the refrigerated display case 10 of the present invention from the air inlet 26 to the air outlet 20.

To facilitate protection of the individual fans 58 a fan basket housing 78 is preferably included with respect to each individual fan member 58. The fan 58 is positioned within the fan basket 78 and that assembled combination is then positioned within the fan opening 56 defined in the fan panel 54. As described above, preferably three such fan assemblies are included within each fan panel 54. Also preferably a fan basket housing 78 includes a flange 80 extending therearound which provides a slightly elevated flange area around the fan opening when the fan is positioned therein to prevent contaminants such as spillages and the like from passing through the fan opening below the fan panel into an area near the refrigeration coil 48. Preferably the individual fans 58 and fan basket housing 78 are selectively removable individually from the individual fan openings 56 to facilitate maintenance thereof.

Figure 9:
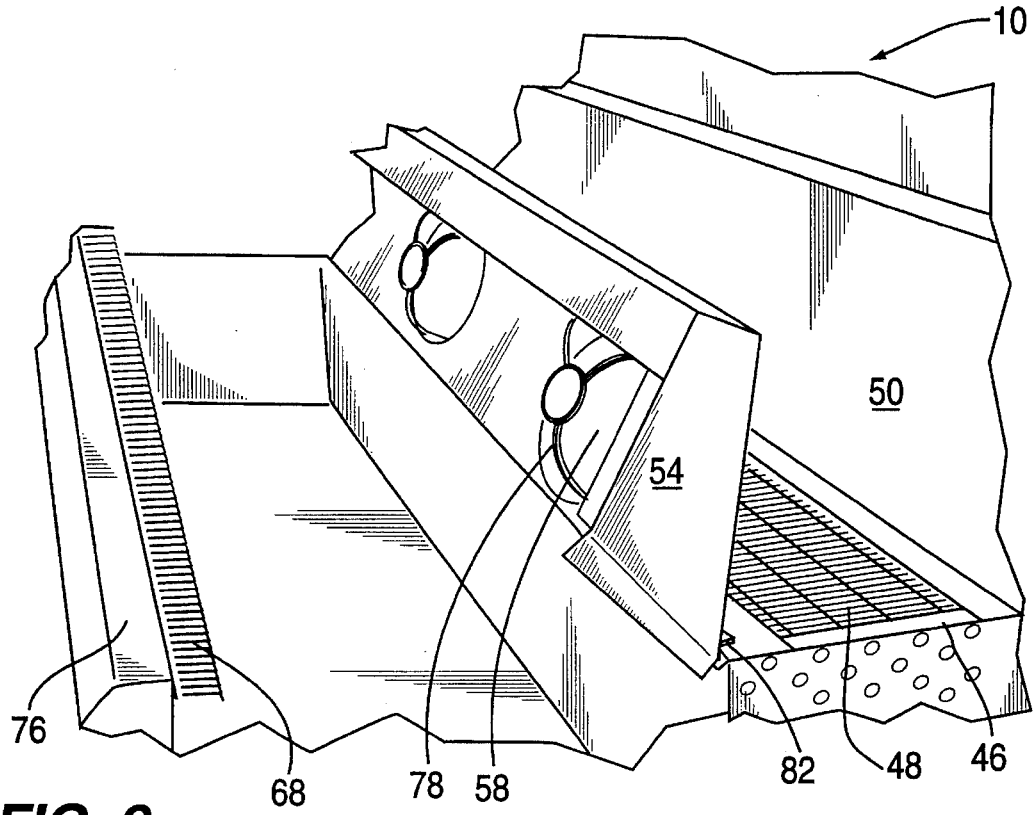
FIG. 9 is a side perspective illustration of an embodiment of the display case apparatus of the present invention showing the fan panel rotated in to an upper position to facilitate access to the refrigeration coil thereadjacent.

The fan panel itself is preferably pivotally mounted with respect to the coil housing 46 of the refrigeration coil 48. By this pivotal mounting such as with a hinge 82 or the like, the fan panel 54 can be rotated upwardly to a position as shown in FIG. 9 to facilitate direct access to the front portion of the refrigeration coil 48. This access can be used for cleaning of the refrigeration coil or for high speed defrost such as by hosing down of the refrigeration coil.

Figure 10:
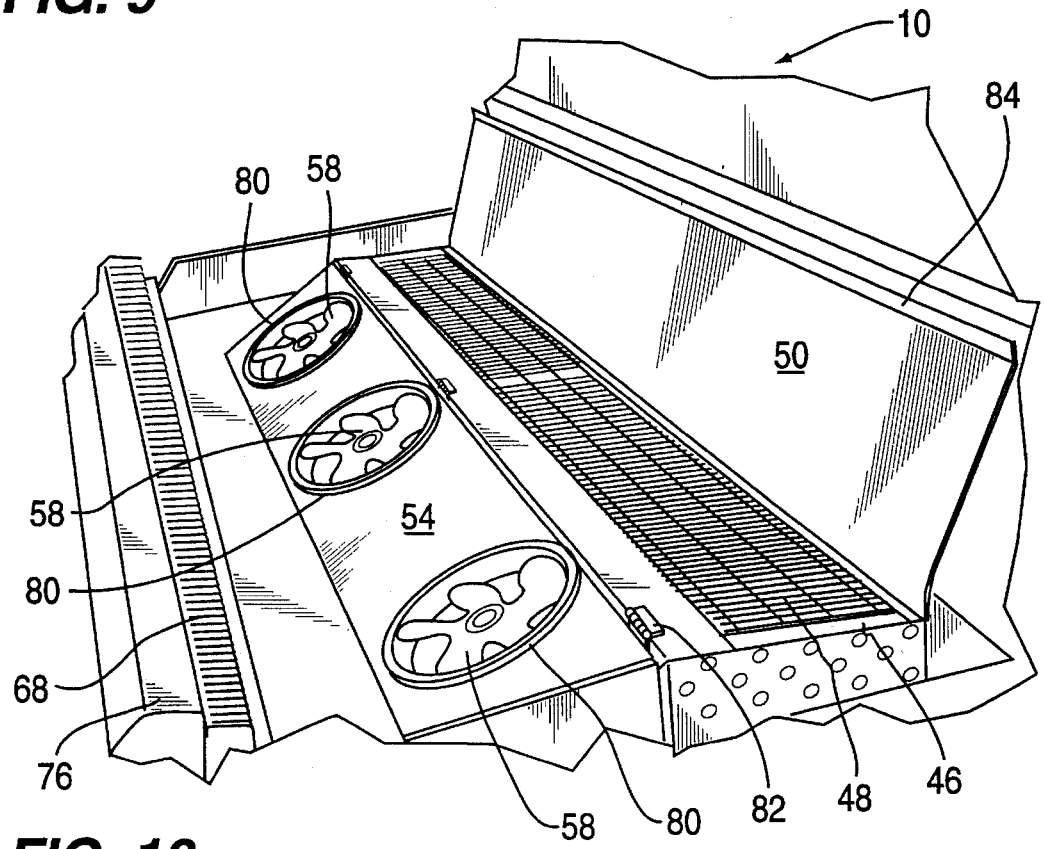
FIG. 10 is an illustration of the embodiment shown in FIG. 9 with the fan panel shown in the steady state position and the coil cover in the upper position to facilitate access to the refrigeration coil therebelow.

Protection of the refrigeration coil 48 is further achieved by the inclusion of a coil cover 50 extending thereover. This coil cover 50 will preferably include a coil cover gasket 84 to facilitate sealing against the refrigeration coil 48 in such a manner as to prevent the flow of contaminants and spillages thereby into contact with the refrigeration coil 48 therebelow. This coil cover 50 is preferably pivotally mounted with respect to the refrigerated display case 10 in such a manner as to pivot upwardly and allow access to the refrigeration coil therebelow without requiring removal of any fastening devices. The positioning of the coil cover 50 in the upper position is shown best in FIG. 10. When in this upper position, the coil cover 50 will allow direct access to the refrigeration coil 48 therebelow to facilitate maintenance access thereto for cleaning or high speed defrosting such as hosing down. In a preferred configuration the coil cover 50 will be inclined downwardly slightly toward the waste outlet means 36 at a very slight angle of approximately two degrees to urge the movement of spillages and other contaminants toward the waste recovery means. Furthermore it is preferable that the coil cover 52 extend slightly outwardly with an extended area 86 thereof such as to overlap the fan panel 54 to achieve a shingling effect to facilitate movement of contaminants such as spillages and the like over the fan panel 54 toward the waste outlet means 36. This cooperative positioning of the coil cover 50 extending over the refrigeration coil at an inclination angle 52 in combination with the fan panel 54 being positioned at a fan panel inclination angle 60 of greater than two degrees significantly minimizes the possibility of contamination of the refrigeration coil 48. The movement of contaminants and spillages over the coil cover 50 and fan panel 54 is best shown by contaminant flow arrows 88 in FIG. 6. As can be seen from the side view of FIG. 1, the fan panel inclination angle 60 is significantly greater than the approximately two degree inclination of the coil cover 52. This is a second layer of contamination protection provided beneath the deck plate 38.

The present invention may further include a front bracket 62 which is preferably fixedly secured with respect to the lower air conduit 22. This front bracket 62 may be positioned adjacent the air inlet 26 and be adapted to receive a return grill 68 detachably mounted thereon such that the return grill extends over the air inlet 26 for protection and aesthetic enhancement thereof. The return grill 68 preferably will include a deck lip 64 thereon which is adapted to receive the deck plate 38 in abutment positioned resting thereon when the deck plate 38 is positioned in the operative position extending across the tank area of the display case.

Furthermore the front bracket 62 can include a support shelf 72 thereon which is adapted to hold and retain refrigeration line means 70 normally positioned in the lowermost portion of the refrigerated display case. This refrigeration line means 70 normally is positioned adjacent to the area where much of the contaminants and spillages are accumulated. By providing the front bracket 62 with a support shelf 72 for holding the refrigeration line 70 above and removed from the waste outlet 36, wiping and other cleaning of the area adjacent to the waste outlet 36 is made significantly easier. The front bracket 62 also preferably provides a means for detachable securement of the front baffle 76 with respect to the refrigerated display case 10.

A rear panel 66 may be included attached to the upper air conduit 16 extending outwardly horizontally therefrom in an area above the refrigeration coil 48. This rear panel 66 will provide a surface upon which the rear portion of the deck plate 38 can rest in abutment. Thus, with this configuration, deck plate 38 will be positioned as shown in FIG. 1 resting upon the upper surface of the rear panel 66 and upon the upper surface of the deck lip 64 of the return grill 68.

In normal operation the fan panel 54 of the present invention will be in the down position as shown in FIG. 1 with the deck plate 38 extending thereabove at an angle 42 of inclination of between zero and seven degrees, with the refrigeration coil 48 positioned adjacent thereto. The deck plate 38 in combination with the outer wall 34 will define the air flow path through the plenum chamber 30. Air will be drawn into the air inlet 26 by operation of the fan means 58 in the fan panel 54. This air will then pass through the lower air flow path 24 into the plenum chamber 30. Fan 58 will then urge the air to pass through the refrigeration coil 48 for cooling thereof and then pass upwardly through the upper air flow path 18 to be expelled outwardly through the air outlet 20 to form the air curtain 14 extending over the front opening 12.

Figure 6:
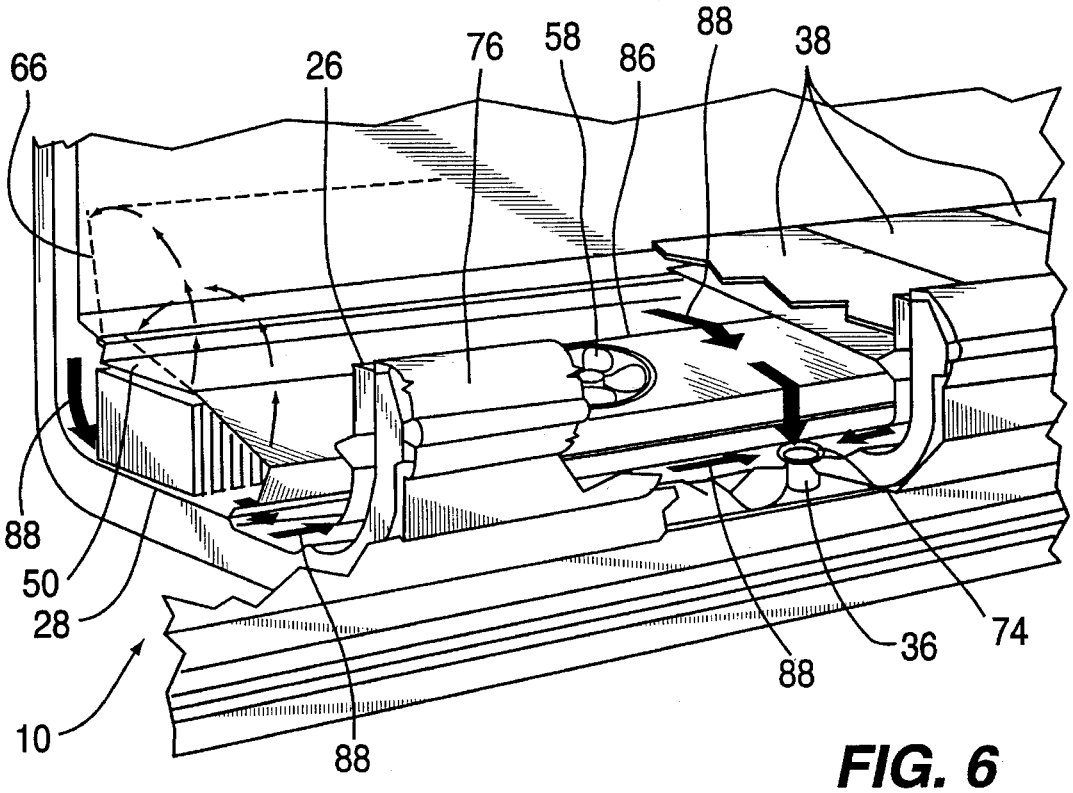
FIG. 6 is a perspective illustration of an embodiment of a multi-layered contaminant control means of the present invention.
Figure 7:
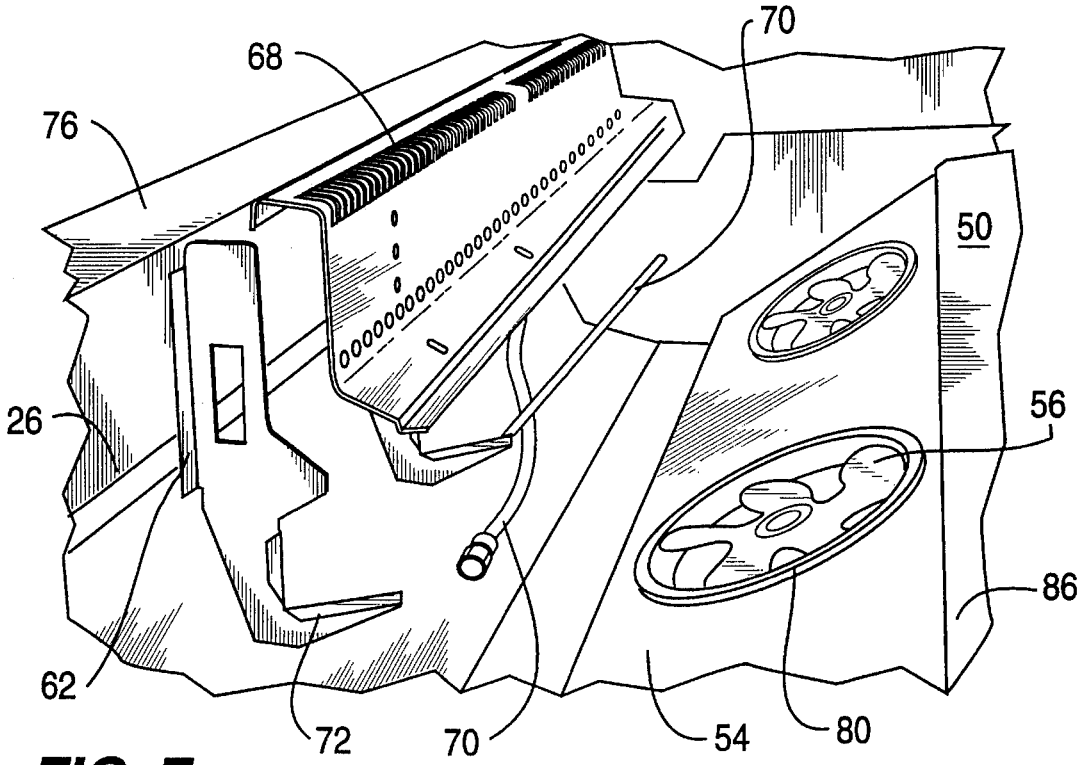
FIG. 7 is a perspective illustration of the lower portion of a refrigerated display case apparatus of the present invention showing the return grill being moved toward a position secured upon the front bracket member.
Figure 8:
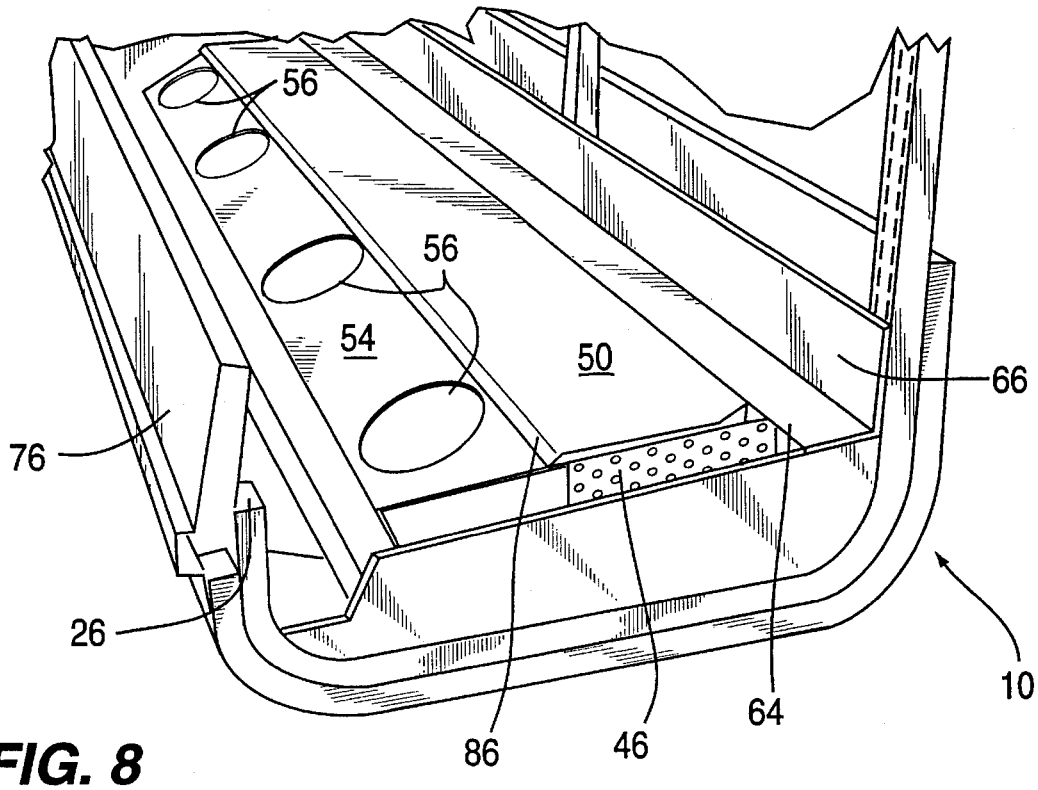
FIG. 8 is a perspective illustration of the lower portion of the tank apparatus of an embodiment of the present invention showing the fan panel prior to placement of the fans therein.

A primary novel characteristic of the present invention is in the use of the combination of the deck plate 38, the coil cover 50 and the fan panel 54 all oriented at inclined angles toward the waste outlet 36 in such a manner as to enhance the movement of contaminants and other spillages thereto-ward as best illustrated by contaminant flow arrows in FIG. 6. With these contaminants being gathered in the waste outlet 36 and in the recessed waste gathering area 74 extending therearound, the present invention also provides a novel and simple means for providing access to this area to facilitate wiping for final cleaning thereof. Also, this cleaning operation can normally be achieved simultaneously with hosing down or defrosting of the refrigeration coil 48.

In practice, maintenance of the refrigerated display case 10 of the present invention is initiated by removal of the deck plates 38 from the position resting at the deck plate angle of inclination 42 of from zero to seven degrees. In alternative constructions the downward inclination can be of other angular measurements including one degree or seven degrees, each of which have been found to be particularly efficient in certain applications. After the deck plate 38 is removed the return grill 68 can then be easily be removed from its position mounted preferably upon the front bracket 62. This will provide direct access by the maintenance worker to the recessed waste gathering area 74 and the waste receiving or outlet means 36. This area can be wiped for maintaining initial cleanliness. Thereafter, if cleaning of the refrigeration coil 48 itself is deemed necessary, the coil cover 50 can be moved to the upper position as shown best in FIG. 10. The upper portion of the refrigeration coil 48 can then be hosed down for cleaning and/or high speed defrosting thereof. Also the fan panel 54 can be rotated to the upper position as shown best in FIG. 9 to facilitate access to the front portion of the refrigeration coil 48 for cleaning and/or high speed defrosting by hosing down thereof. In this manner a simple and expedient means of providing cleaning of the lower portion of a refrigerated display case is made possible. These lower areas normally accumulate spillages and other contaminants from the many different types of products displayed thereabove and the construction of the present invention provide a means for easily preventing standing water or hidden contaminants from finding their way into remote areas in the display case tanks area.

Another particularly novel aspect of the present invention is in the use of the front bracket which provides a combination of utilities. The front bracket 62 includes a shelf for holding of the refrigeration lines 70 away from the waste accumulation area while at the same time providing a means for detachable securement of the return grill 68 with respect to the air inlet 26 which, in turn, includes a deck lip 64 to facilitate laying of the deck plate 38 thereon.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A refrigerated display case apparatus with an improved air flow control and a contaminant control apparatus and having a frontal opening with a refrigerated air curtain extending thereover comprising:

A. an upper air conduit means extending upwardly along a refrigerated display case to define an upper air flow path therein for conveying refrigerated air therethrough, said upper air conduit means defining an air outlet means therein above the frontal opening of the refrigerated display case for releasing refrigerated air therefrom to form a refrigerated air curtain extending thereover, said air outlet means being in fluid flow communication with respect to said upper air conduit means;

B. a lower air conduit means extending upwardly within said refrigerated display case to define a lower air flow path and an air inlet means below the frontal opening to receive air therein from the refrigerated air curtain extending over the frontal opening of the refrigerated display case, said air inlet means being in fluid flow communication with respect to said lower air flow path;

C. a plenum housing attached with respect to said upper air conduit means and said lower air conduit means, said plenum housing defining a plenum chamber means therein in fluid flow communication with respect to said lower air flow path of said lower air conduit means to receive air therefrom returning through said air inlet means from the refrigerated air curtain, said plenum chamber means also being in fluid flow communication with respect to said upper air flow path of said upper air conduit means to supply refrigerated air thereto for exiting through said air outlet means, said plenum housing including;

(1) a plenum outer liner means extending from said lower air conduit means to said upper air conduit means to define an outer wall means of said plenum chamber means, said plenum outer liner means including a waste receiving means therein adapted to gather contaminants from within the refrigerated display case;

(2) a deck plate means detachably positioned in abutment with respect to and extending from said lower air conduit means, said deck plate means also being detachably in abutment with respect to said upper air conduit means and extending outwardly over said plenum chamber means to said lower air conduit means to define an inner wall means of said plenum chamber means, said inner wall means and said outer wall means defining said plenum chamber means therebetween;

D. an air flow control apparatus positioned within said plenum chamber means and comprising:

(1) a coil housing means including a refrigeration coil means mounted therein, said coil housing means be positioned within said plenum chamber means for cooling of air therein;

(2) a coil cover means positionable extending outwardly over said refrigeration coil means for protection thereof and to enhance air flow therethrough, said coil cover means being inclined downwardly toward said waste receiving means to facilitate movement of any contaminants therein, said coil cover means being pivotally attached with respect to said coil housing means to facilitate selective access to said refrigeration coil means;

(3) a fan panel means positioned within said plenum chamber means pivotally mounted adjacent said coil housing means for moving air therethrough for refrigeration thereof, said fan panel means defining at least one fan opening means therein, said fan panel means being pivotally mounted with respect to said coil housing means to facilitate further access thereto, said fan panel means being inclined downwardly toward said waste receiving means to facilitate movement of contaminants therein; and (4) at least one fan means positioned within said fan opening means of said fan panel means, said fan means adapted to draw air from said lower air conduit means into said plenum chamber means for passing through said refrigeration coil means for cooling thereof and into said upper air conduit means for supplying of refrigerated air to exit through said air outlet means to form a refrigerated air curtain over the frontal opening of the refrigerated display case.

2. A refrigerated display case apparatus with an improved air flow control and a contaminant control apparatus and having a frontal opening with a refrigerated air curtain extending thereover as defined in claim 1 further comprising a front bracket means fixedly secured to said lower air conduit means adjacent said air inlet means and further including a return grill means detachably secured with respect to said front bracket means extending over said air inlet means, said return grill means including a deck lip means extending outwardly therefrom adapted to receive said deck plate means positioned thereon in detachable abutment with said front bracket means for positioning of said deck plate means removably with respect to said lower air conduit means.

3. A refrigerated display case apparatus with an improved air flow control and a contaminant control apparatus and having a frontal opening with a refrigerated air curtain extending thereover as defined in claim 1 further comprising a rear panel fixedly secured to said upper air conduit means and extending outwardly therefrom and wherein said deck plate means is positionable in abutment thereon.

4. A refrigerated display case apparatus with an improved air flow control and a contaminant control apparatus and having a frontal opening with a refrigerated air curtain extending thereover as defined in claim 1 further comprising a return grill means detachably secured with respect to said lower air conduit means in a position extending over said air inlet means.

5. A refrigerated display case apparatus with an improved air flow control and a contaminant control apparatus and having a frontal opening with a refrigerated air curtain extending thereover as defined in claim 1 further comprising a front bracket means fixedly secured to said lower air conduit means adjacent said air inlet means and wherein said return grill means is detachably securable to said front bracket means in a position extending over said air inlet means.

6. A refrigerated display case apparatus with an improved air flow control and a contaminant control apparatus and having a frontal opening with a refrigerated air curtain extending thereover as defined in claim 1 further comprising at least one refrigeration line means positioned within the refrigerated display case and further defining a front bracket means fixedly secured to said lower air conduit means and including a support shelf for retaining of said refrigeration lines means thereon to allow said refrigeration line means to be spatially disposed upwardly from said waste receiving means.

7. A refrigerated display case apparatus with an improved air flow control and a contaminant control apparatus and having a frontal opening with a refrigerated air curtain extending thereover as defined in claim 1 wherein said deck plate means is inclined downwardly toward said waste receiving means to facilitate gathering of contaminants therein.

8. A refrigerated display case apparatus with an improved air flow control and a contaminant control apparatus and having a frontal opening with a refrigerated air curtain extending thereover as defined in claim 1 wherein said coil cover means is inclined downwardly toward said waste receiving means at an angle of approximately two degrees.

9. A refrigerated display case apparatus with an improved air flow control and a contaminant control apparatus and having a frontal opening with a refrigerated air curtain extending thereover as defined in claim 1 wherein said plenum outer liner means defines a recessed waste gathering area surrounding said waste receiving means to facilitate movement of contaminants thereto.

10. A refrigerated display case apparatus with an improved air flow control and a contaminant control apparatus and having a frontal opening with a refrigerated air curtain extending thereover as defined in claim 1 wherein said fan panel means is inclined downwardly toward said waste receiving means at an angle greater than two degrees.

11. A refrigerated display case apparatus with an improved air flow control and a contaminant control apparatus and having a frontal opening with a refrigerated air curtain extending thereover as defined in claim 1 further comprising front bracket means fixedly secured to said lower air conduit means and further including a front baffle means secured to said front bracket means to be fixedly secured with respect to the refrigerated display case.

12. A refrigerated display case apparatus with an improved air flow control and a contaminant control apparatus and having a frontal opening with a refrigerated air curtain extending thereover as defined in claim 1 wherein said waste receiving means comprises a waste outlet means for removal of contaminants from the refrigerated display case.

13. A refrigerated display case apparatus with an improved air flow control and a contaminant control apparatus and having a frontal opening with a refrigerated air curtain extending thereover as defined in claim 1 further comprising a fan basket housing means adapted to receiving said fan means mounted therein, said fan basket housing means being positionable within said fan opening means defining in said fan panel means for retaining of said fan means positioned therein safely.

14. A refrigerated display case apparatus with an improved air flow control and a contaminant control apparatus and having a frontal opening with a refrigerated air curtain extending thereover as defined in claim 13 wherein said fan basket housing means includes a flange means positioned extending around said fan opening means with said fan basket housing means positioned therein to inhibit contaminants from entering said fan opening means.

15. A refrigerated display case apparatus with an improved air flow control and a contaminant control apparatus and having a frontal opening with a refrigerated air curtain extending thereover as defined in claim 1 wherein said fan panel means includes three fan openings and wherein said fan means comprises three fans positionable each within one of said fan openings.

16. A refrigerated display case apparatus with an improved air flow control and a contaminant control apparatus and having a frontal opening with a refrigerated air curtain extending thereover as defined in claim 1 further comprising a hinge means secured to said coil housing means and said fan panel means to allow pivotal relative movement therebetween.

17. A refrigerated display case apparatus with an improved air flow control and a contaminant control apparatus and having a frontal opening with a refrigerated air curtain extending thereover as defined in claim 1 wherein said air flow control apparatus includes a coil cover gasket means positioned between said coil housing means and said coil cover means to inhibit movement of contaminants into said refrigeration coil means.

18. A refrigerated display case apparatus with an improved air flow control and a contaminant control apparatus and having a frontal opening with a refrigerated air curtain extending thereover as defined in claim 1 wherein said upper air conduit means is L-shaped.

19. A refrigerated display case apparatus with an improved air flow control and a contaminant control apparatus and having a frontal opening with a refrigerated air curtain extending thereover as defined in claim 1 wherein said fan panel means is made of aluminum.

20. A refrigerated display case apparatus with an improved air flow control and a contaminant control apparatus and having a frontal opening with a refrigerated air curtain extending thereover as defined in claim 1 wherein said coil cover means extends over said fan panel means to inhibit contaminants from passing therebetween into said refrigeration coil means.

21. A refrigerated display case apparatus with an improved air flow control and a contaminant control apparatus and having a frontal opening with a refrigerated air curtain extending thereover comprising:

A. an upper air conduit means extending upwardly along a refrigerated display case to define an upper air flow path therein for conveying refrigerated air therethrough, said upper air conduit means defining an air outlet means therein above the frontal opening of the refrigerated display case for releasing refrigerated air therefrom to form a refrigerated air curtain extending thereover, said air outlet means being in fluid flow communication with respect to said upper air conduit means;

B. a lower air conduit means extending upwardly within said refrigerated display case to define a lower air flow path and an air inlet means below the frontal opening to receive air therein from the refrigerated air curtain extending over the frontal opening of the refrigerated display case, said air inlet means being in fluid flow communication with respect to said lower air flow path;

C. a plenum housing attached with respect to said upper air conduit means and said lower air conduit means, said plenum housing defining a plenum chamber means therein in fluid flow communication with respect to said lower air flow path of said lower air conduit means to receive air therefrom returning through said air inlet means from the refrigerated air curtain, said plenum chamber means also being in fluid flow communication with respect to said upper air flow path of said upper air conduit means to supply refrigerated air thereto for exiting through said air outlet means, said plenum housing including;

(1) a plenum outer liner means extending from said lower air conduit means to said upper air conduit means to define an outer wall means of said plenum chamber means, said plenum outer liner means including a waste receiving means therein adapted to gather contaminants from within the refrigerated display case, said plenum outer liner means further defining a recessed waste gathering area surrounding said waste receiving means to facilitate movement of contaminants thereto, said waste receiving means defining a waste outlet means for effecting removal of contaminants from the refrigerated display case;

(2) a deck plate means detachably positioned attached with respect to and extending from said lower air conduit means, said deck plate means also being detachably in abutment with respect to said upper air conduit means and extending outwardly over said plenum chamber means to said lower air conduit means to define an inner wall means of said plenum chamber means, said inner wall means and said outer wall means defining said plenum chamber means therebetween, said deck plate means being inclined downwardly at an angle of approximately seven degrees toward said waste receiving means to facilitate movement of contaminants therein;

(3) a rear panel means fixedly secured to said upper air conduit and extending outwardly therefrom to receive said deck plate means in abutment therewith to facilitate attachment of said deck plate means detachably with respect to said coil housing means;

Do an air flow control apparatus positioned within said plenum chamber means and comprising:

(1) a coil housing means including a refrigeration coil means mounted therein, said coil housing means be positioned within said plenum chamber means for cooling of air therein;

(2) a coil cover means positionable extending outwardly over said refrigeration coil means for protection thereof, said coil cover means being inclined downwardly at an angle of approximately two degrees toward said waste receiving means at an angle of greater than two degrees to facilitate movement of any contaminants therein, said coil cover means being pivotally attached with respect to said coil housing means to facilitate selective access to said refrigeration coil means, said coil cover means including a coil cover gasket means positioned between said coil cover means and said coil housing means to inhibit movement of contaminants into said refrigeration coil means;

(3) a fan panel means positioned within said plenum chamber means pivotally mounted adjacent said coil housing means for moving air therethrough for refrigeration thereof, said fan panel means defining at least one fan opening means therein, said fan panel means being pivotally mounted with respect to said coil housing means to facilitate further access thereto, said fan panel means being inclined downwardly toward said waste receiving means to facilitate movement of contaminants therein, said coil cover means extending over said fan panel means to inhibit movement of contaminants therebetween into said refrigeration coil means;

(4) fan hinge means secured to said fan panel means and to said coil housing means to achieve pivotally moveable securement therebetween;

(5) a fan basket housing means positionable within each of said fan opening means and including a flange means extending therearound to inhibit movement of contaminants through said fan opening means into said refrigeration coil means;

(6) at least one fan means positioned within each of said fan basket housing means within said fan opening means of said fan panel means, said fan means adapted to draw air from said lower air conduit means into said plenum chamber means for passing through said refrigeration coil means for cooling thereof and into said upper air conduit means for supplying of refrigerated air to exit through said air outlet means to form a refrigerated air curtain over the frontal opening of the refrigerated display case;

(7) refrigeration line means positioned within said plenum chamber means adjacent said waste receiving means;

E. a front bracket means fixedly secured to said lower air conduit means adjacent said air inlet means, said front bracket means including a support shelf means adapted to receive said refrigeration line means positioned thereon to facilitate movement of contaminants toward said waste receiving means and cleaning therearound;

F. a return grill means detachably securable onto said front bracket means to extend over said air inlet means, said return grill means including a deck lip means extending outwardly therefrom and adapted to receive said deck plate means positioned thereon in detachable abutment with said front bracket means for positioning of said deck plate means detachably with respect to said lower air conduit means; and G. a front baffle means fixedly secured to said front bracket means for securement thereof with respect to the refrigerated display case.

* * * * *